United States Patent [19]

Clausen

[11] 4,377,981

[45] Mar. 29, 1983

[54] LATERAL THRUST RUDDER

[75] Inventor: Ferdinand Clausen, Remagen-Oberwinter, Fed. Rep. of Germany

[73] Assignee: Scottel-Werft, Josef Becker GmbH & Co. KG, Spay, Fed. Rep. of Germany

[21] Appl. No.: 258,702

[22] Filed: Apr. 29, 1981

[30] Foreign Application Priority Data

May 2, 1980 [DE] Fed. Rep. of Germany ..... 3016948

[51] Int. Cl.[3] ..... B63H 25/46

[52] U.S. Cl. ..... 114/151; 440/43

[58] Field of Search ..... 114/151, 162; 239/265.19; 440/38, 40, 43, 42

[56] References Cited

U.S. PATENT DOCUMENTS 3,464,357 9/1969 Duport ..... 114/151

3,593,686 7/1971 Cooper et al. ..... 114/151

FOREIGN PATENT DOCUMENTS 2131101 1/1973 Fed. Rep. of Germany ..... 114/151

*Primary Examiner*—Trygve M. Blix

*Assistant Examiner*—Jesús D. Sotelo

*Attorney, Agent, or Firm*—Flynn, Thiel, Boutell & Tanis

[57] ABSTRACT

A lateral thrust rudder for a ship includes a cross-channel extending transversely through the ship from one side thereof to the other side and a water conveying mechanism such as a propeller is provided in the cross-channel. A guide vane is pivotally mounted on a horizontal axle at each end of the cross-channel and extends inwardly into the cross-channel. The lower part of each end of the channel is rounded so it flares outwardly. Normally the guide vanes are controlled solely by water flow through the cross-channel but, where necessary, a drive mechanism can be provided for the vanes.

5 Claims, 1 Drawing Figure

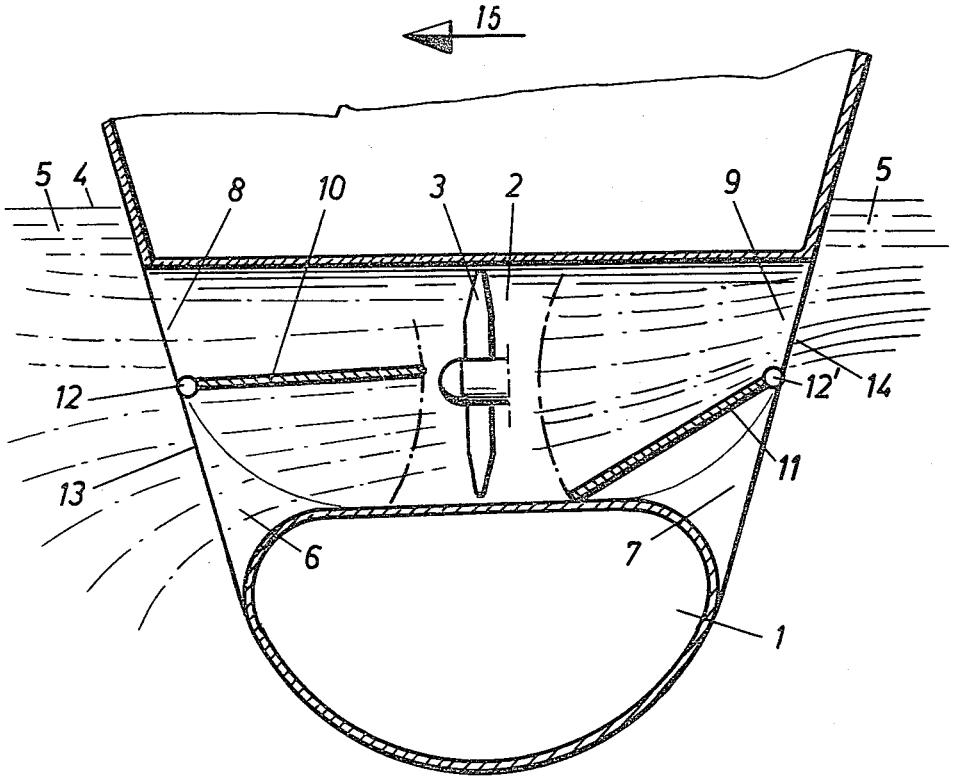
15
5
4
8
10
3
2
9
5
12
12'
14
11
13
6
7
1

LATERAL THRUST RUDDER

FIELD OF THE INVENTION

The invention relates to a lateral thrust rudder for a ship or the like having a water conveying mechanism in a cross-channel in the ship.

BACKGROUND OF THE INVENTION

Lateral thrust rudders are known in which a water conveying mechanism for producing a thrust, for example, a propeller, is supported in a cross-channel which extends from one side of the ship to the other. Also, lateral thrust rudders are known in which the channel system is T-shaped, the water being sucked in for example at the bottom of the ship or at the bow and ejected selectively to one side or the other. These lateral thrust rudders are used to give the ship a lateral thrust, depending on the direction in which the water is ejected from the cross-channel, in order to make maneuvering of the ship easier. Lateral thrust rudders are also known in which the channel openings can be closed off with hatches.

The end openings of conventional cross-channels which extend from one side of the ship to the other serve, due to the necessary change in the water flow direction, at one time as an inlet and at another time as an outlet. Even though an inlet should ideally be shaped differently than an outlet to facilitate the water flow, both channel ends must in practice always have the same shape and size. Thus, the water cannot be accelerated within the cross-channel, but must receive its necessary acceleration during entrance to the channel on the suction side of the propeller. In addition to the poor propeller efficiency which results, there exists a danger of air penetration causing a sudden interruption of the thrust force, cavitation, and all common side effects. Further, the thrust force decreases rapidly with increasing speed of the ship and stops completely during moderate travel of the ship, due to the ejector or suction action of the bypassing water. Similar disadvantages are present in conventional lateral thrust rudders having a T-shaped channel system.

The basic purpose of the invention is therefore to avoid the foregoing disadvantages and, in particular, to improve efficiency and to avoid or at least strongly reduce cavitation.

SUMMARY OF THE INVENTION

The basic purpose of the invention is attained with a lateral thrust rudder which has a pivotally supported guide vane at an end of the cross-channel projecting into the channel. Preferably, such a guide vane is provided at each end of the cross-channel.

Depending on the requirements placed on the lateral thrust rudder, the axis of movement of the movable guide vane can be directed appropriately. In practically all cases, a horizontal axle is advantageous.

The guide vanes according to the invention are typically held in a neutral position by the water flow into the cross-channel at the inlet side, and are positionally adjusted inventively at the outlet side by their own weight and a sensitive balance. However, an additional manual or automatic drive may be necessary in some circumstances.

To improve the flow characteristics, it is advantageous to design the end openings of the cross-channel funnel-shaped or rounded in the lower part which can be covered by the guide vane.

The lateral thrust rudder according to the invention has the following advantages. Efficiency is considerably improved through the flow-favorable design of the channel openings which alternately serve at one time as a water inlet and at another time as an ejection nozzle. In addition, energy conversion or water acceleration exists mainly on the pressure side of the propeller and cavitations are avoided, due to the better water flow. Due to the improved efficiency, it is possible to choose a smaller and thus energy-saving lateral thrust rudder and still achieve the required thrust strength. The danger of air penetration is reduced because the water flows in mainly from below, and therefore the height of the water surface above the channel ends can be less. This, together with the smaller dimensions of the inventive lateral thrust rudder, permits its installation in ships with a limited draft. Thrust action during travel of the ship is improved, due to the more favorable construction of the channel openings, because the suction action of passing water is reduced. The guide vanes are inexpensive and normally do not need any maintenance or service. They usually operate completely automatically without any control devices. Subsequent installation of the guide vanes and the better design of the channel ends in existing lateral thrust rudders is possible in most cases without great expense.

BRIEF DESCRIPTION OF THE DRAWING

The invention will be discussed hereinafter in connection with the drawing, which is a vertical cross-sectional view of a ship illustrating an exemplary embodiment of a lateral thrust rudder.

DETAILED DESCRIPTION

The drawing is a vertical cross-sectional view of a portion of a ship 1 having a lateral thrust rudder according to the invention. The lateral thrust rudder includes a cross-channel 2 which extends transversely through the ship from one side thereof to the other side and a propeller 3 which is rotatably supported in the cross-channel 2. The support and drive mechanism for the propeller are conventional and therefore not shown. The cross-channel may have a circular, square or a differently shaped cross section. Guide vanes 10 and 11 are freely and pivotally supported by axles 12 and 12' at respective ends 13 and 14 of the cross-channel 2 so that the center of gravity of each lies within the cross-channel 2. They are designed so that they project inwardly and downwardly in their dropped-down position, as can be seen from vane 11 in the figure, and thereby cover the lower part of the cross-channel 2. The openings at the respective ends of the cross-channel 2 are substantially sharp-edged in the upper parts 8 and 9 thereof and are funnel-shaped, rounded or otherwise designed flow-favorably in the lower parts 6 and 7 thereof.

If, for example, the propeller 3 moves the water from the left to the right in the drawing, the guide vane 10, which until then is in the dropped-down position, is lifted by the flow of water and is automatically adjusted to a position favoring the water flow as shown in the drawing. The other guide vane 11 remains in the downwardly inclined rest position, however, and is held there by the water flow. Since the lower part 6 of the channel end opening 13 is rounded so as to be flow-favorable, the water flows into the inlet side 13 substantially from below. Only the sharp-edged upper part 9 is open on the outlet side 14 of the channel 2, whereby an ideal nozzle is formed which produces a clustered waterjet and urges the ship in the direction of arrow 15. Through this, the layer of water 5 near the water surface 4 remains substantially undisturbed. When the water flow direction in the channel 2 is changed, the guide vanes 10 and 11 automatically reverse their function. If for any reason the weight distribution of the guide vanes 10 and 11 is not sufficient, then a conventional drive mechanism can be provided for them. In any case, the weight distribution can be appropriately adjusted by counterbalancing the vanes 10 and 11 in a conventional manner.

The invention is not limited to use of a propeller as the water conveying mechanism, as it is possible to use any other device which produces a thrust. The cycloidal propeller is mentioned only as an example.

The invention can also be applied on types of lateral thrust rudders other than that shown in the exemplary embodiment, for example on lateral thrust rudders having a channel system which is T-shaped. The important feature of the invention is the movable guide vane at the channel opening.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A lateral thrust apparatus for a ship, comprising an opening provided in one side of the ship, a channel in the ship communicating with said opening, means for selectively effecting a flow of water in one of a first direction into said channel through said opening and a second direction out of said channel through said opening, and a vane freely pivotally supported at one end in said opening for movement about an axis which extends across said opening, said vane projecting into said channel from said axis and being movable in response to water flowing respectively in said first and second directions between a first position generally parallel to said first direction of flow of said water and a second position inclined with respect to said second direction of water flow and substantially obstructing the flow of water through a portion of said opening which is disposed substantially on one side of said axis, whereby when said vane is in said second position and water is flowing in said second direction, said vane forces substantially all of the water to pass through the portion of said opening disposed on the side of said axis opposite said one portion thereof.

2. The lateral thrust apparatus of claim 1, wherein said axis is substantially horizontal and said first position of said vane is located above said second position thereof, the weight of said vane urging said vane toward said second position.

3. The lateral thrust apparatus of claim 1, wherein the lower part of said opening is funnel-shaped to facilitate the flow of water into said opening, and wherein the upper part of said opening has a sharply defined edge.

4. The lateral thrust apparatus of claim 1, including a further said opening in a side of said ship opposite said one side thereof, said channel extending between said openings, including a further said vane freely pivotally supported in said further opening, and wherein said means for effecting a flow of water through said channel includes at least one propeller rotatably supported in said channel between said openings.

5. The lateral thrust apparatus of claim 1, including a further said opening in a side of said ship opposite said one side thereof, said channel extending between said openings; including a further said vane freely pivotally supported at one end in said further opening for movement about a further axis which extends across said further opening, said axes of said first-mentioned and further vanes each being substantially horizontal and said first position of each said vane being located above said second position thereof, the weight of each said vane urging it toward said second position; and wherein the lower part of each said opening is funnel-shaped to facilitate the flow of water into said channel and the upper part of each said opening has a sharply defined edge.

* * * * *

UNITED STATES PATENT AND TRADEMARK OFFICE

CERTIFICATE OF CORRECTION

PATENT NO. : 4 377 981

DATED : March 29, 1983

INVENTOR(S) : Ferdinand Clausen

It is certified that error appears in the above-identified patent and that said Letters Patent is hereby corrected as shown below:

On the title page, change the Assignee from "Scottel-Werft, Josef Becker GmbH & Co. KG" to ---Schottel-Werft, Josef Becker GmbH & Co. KG---.

Signed and Sealed this

Ninth Day of August 1983

[SEAL]

*Attest:*

GERALD J. MOSSINGHOFF

*Attesting Officer*

*Commissioner of Patents and Trademarks*